US009484662B2

(12) United States Patent
Guo et al.

(10) Patent No.: US 9,484,662 B2
(45) Date of Patent: Nov. 1, 2016

(54) ELECTRICAL CONNECTOR WITH IMPROVED TERMINAL MODULE

(71) Applicant: FOXCONN INTERCONNECT TECHNOLOGY LIMITED, Grand Cayman (KY)

(72) Inventors: Bin Guo, Kunshan (CN); Chun-Ming Yu, Kunshan (CN); Guo-Hua Zhang, Kunshan (CN); Qi-Sheng Zheng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/946,706

(22) Filed: Nov. 19, 2015

(65) Prior Publication Data

US 2016/0141806 A1 May 19, 2016

(30) Foreign Application Priority Data

Nov. 19, 2014 (CN) ..... 2014 2 0695455 U

(51) Int. Cl.

| | |
|---|---|
| ***H01R 13/504*** | (2006.01) |
| ***H01R 13/6585*** | (2011.01) |
| ***H01R 13/6594*** | (2011.01) |
| *H01R 24/60* | (2011.01) |
| *H01R 107/00* | (2006.01) |

(52) U.S. Cl.

CPC ..... *H01R 13/504* (2013.01); *H01R 13/6585* (2013.01); *H01R 13/6594* (2013.01); *H01R 24/60* (2013.01); *H01R 2107/00* (2013.01)

(58) Field of Classification Search

CPC ..... H01R 24/60; H01R 13/6581; H01R 2107/00; H01R 24/64; H01R 12/721; H01R 13/52; H01R 13/6205; H01R 13/622; H01R 13/623; H01R 13/629; H01R 13/631; H01R 13/64; H01R 13/648; H01R 13/658

See application file for complete search history.

(56) References Cited

U.S. PATENT DOCUMENTS

| | | | | |
|---|---|---|---|---|
| 2011/0028047 | A1* | 2/2011 | Wang | H01R 4/2433 439/673 |
| 2011/0256764 | A1* | 10/2011 | Wu | H01R 12/598 439/607.01 |
| 2012/0202363 | A1* | 8/2012 | McNamara | H01R 13/6461 439/74 |
| 2012/0276777 | A1* | 11/2012 | Lv | H01R 13/6581 439/607.01 |
| 2013/0040492 | A1* | 2/2013 | Wu | H01R 13/5808 439/607.55 |
| 2014/0073184 | A1* | 3/2014 | Zhao | H01R 13/6594 439/607.55 |
| 2015/0111433 | A1* | 4/2015 | Hou | H01R 12/707 439/626 |
| 2015/0171562 | A1* | 6/2015 | Gao | H01R 13/6582 439/345 |
| 2015/0222059 | A1 | 8/2015 | Little et al. | |

* cited by examiner

*Primary Examiner* — Truc Nguyen

(74) *Attorney, Agent, or Firm* — Wei Te Chung; Ming Chieh Chang

(57) ABSTRACT

A receptacle connector for mating with the plug connector, includes a terminal unit, a metallic shield and a mating cavity surrounded by the metallic shield. The terminal unit includes a terminal module having a first insulator with a plurality of first contacts embedded therein via a first stage insert-molding process, a second insulator with a plurality of second contacts embedded therein via the similar first stage insert-molding process. The first insulator includes a first front insulator and a first rear insulator spaced from each other while linked together by the corresponding first contacts; the second insulator includes a second front insulator and a second rear insulator spaced from each other while linked together by the corresponding second contacts.

19 Claims, 10 Drawing Sheets

ELECTRICAL CONNECTOR WITH IMPROVED TERMINAL MODULE

BACKGROUND OF THE INVENTION

1. Field of the Invention

The present invention relates to an electrical connector assembly, and more particularly to an electrical connector with improvements to assembling.

2. Description of Related Art

Type C USB specification was issued on Aug. 11, 2014. The size of the receptacle connector is essentially small to replace the micro-USB connector while the number of the corresponding contacts is much more than that of micro-USB. On the other hand, all the contacts are arranged in two rows in a diagonally symmetrical manner for mating with the corresponding plug connector in a flippable manner, i.e., two orientations with the same effect. Anyhow, the traditional two stage insert-molding process as disclosed in US Pub. No. 2015/0222059 may disadvantageously have some manufacturing difficulties to remove the linking bridges between the neighboring contacts in the contact carrier for finalize the terminal module because of the existing insulator around those linking bridges.

A new structure of the receptacle connector is desired.

SUMMARY OF THE INVENTION

A receptacle connector for mating with the plug connector, includes a terminal unit, a metallic shield and a mating cavity surrounded by the metallic shield. The terminal unit includes a terminal module having a first insulator with a plurality of first contacts embedded therein via a first stage insert-molding process, a second insulator with a plurality of second contacts embedded therein via the similar first stage insert-molding process, a metallic shielding plate sandwiched between the first insulator and the second insulator, and an insulative tongue piece integrally formed with a combination of the first insulator, the second insulator and the shielding plate via a second stage insert-molding process. The first insulator includes a first front insulator and a first rear insulator spaced from each other while linked together by the corresponding first contacts; the second insulator includes a second front insulator and a second rear insulator spaced from each other while linked together by the corresponding second contacts. The linking bridges between every adjacent two contacts are located and also easily removed in the space between the first front insulator and the first rear insulator. It is also easy to inspect whether the linking bridges are completely removed from the corresponding contacts. The space is successively filled with the material of the tongue piece.

DETAILED DESCRIPTION OF THE PREFERRED EMBODIMENT

Figure 1:
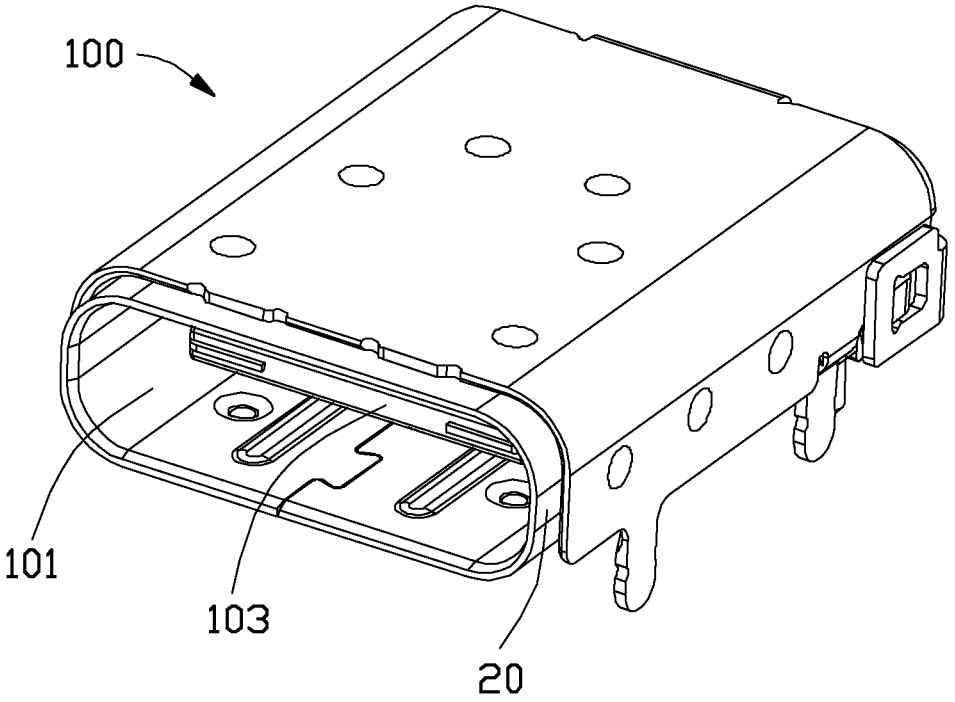
FIG. 1 is an assembled perspective view of a receptacle connector assembly in accordance with the present invention.
Figure 2:
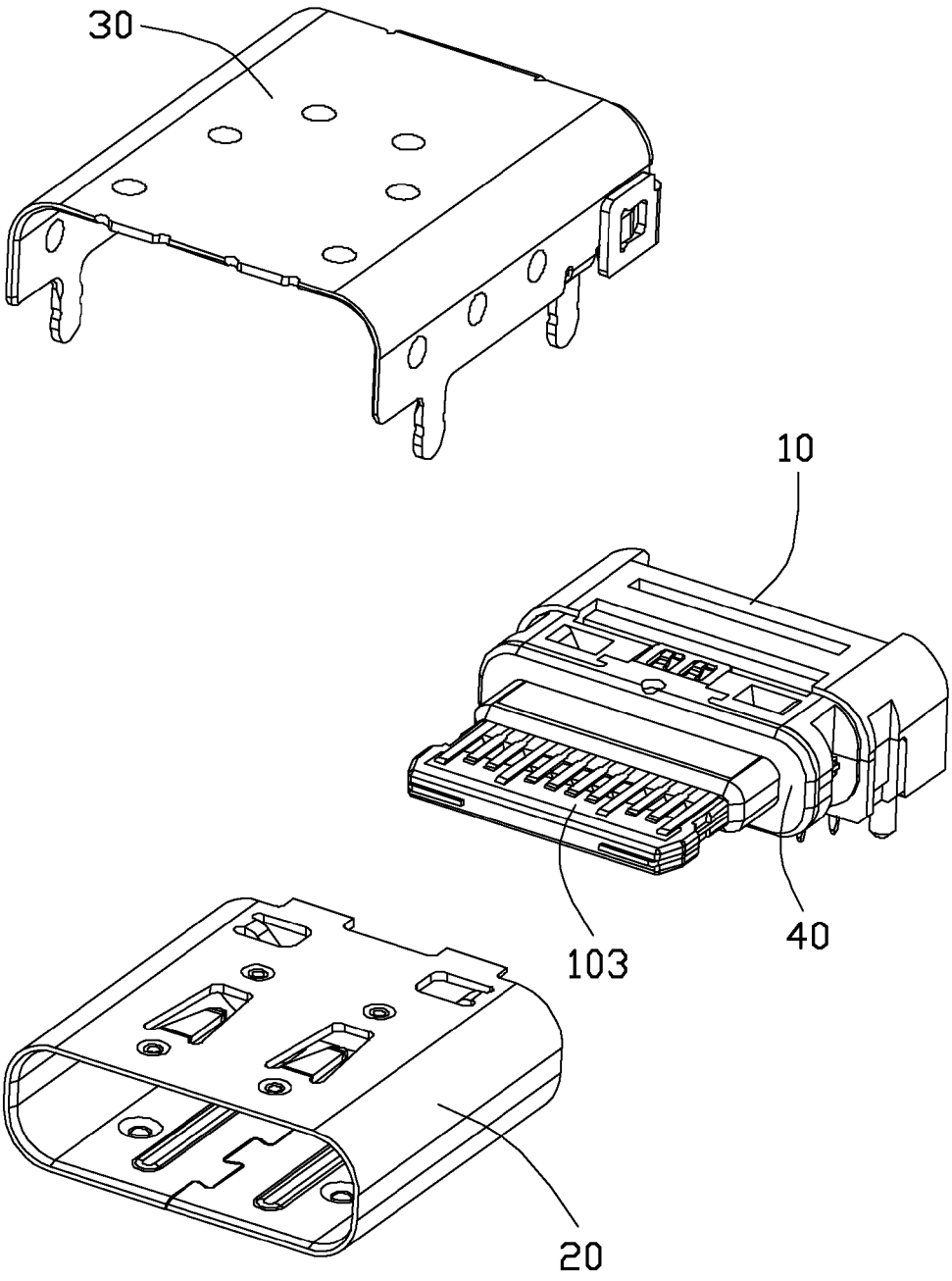
FIG. 2 is an exploded perspective view of the receptacle in FIG. 1.
Figure 3:
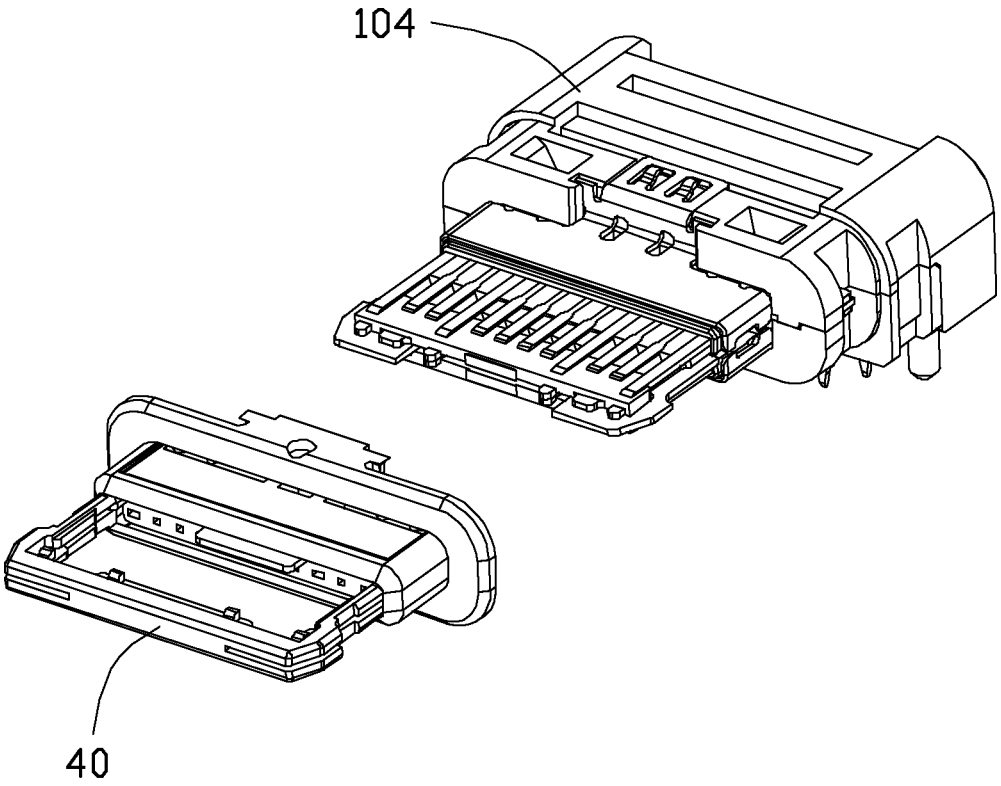
FIG. 3 is a further exploded perspective view of the terminal unit of the receptacle connector in FIG. 2.
Figure 4:
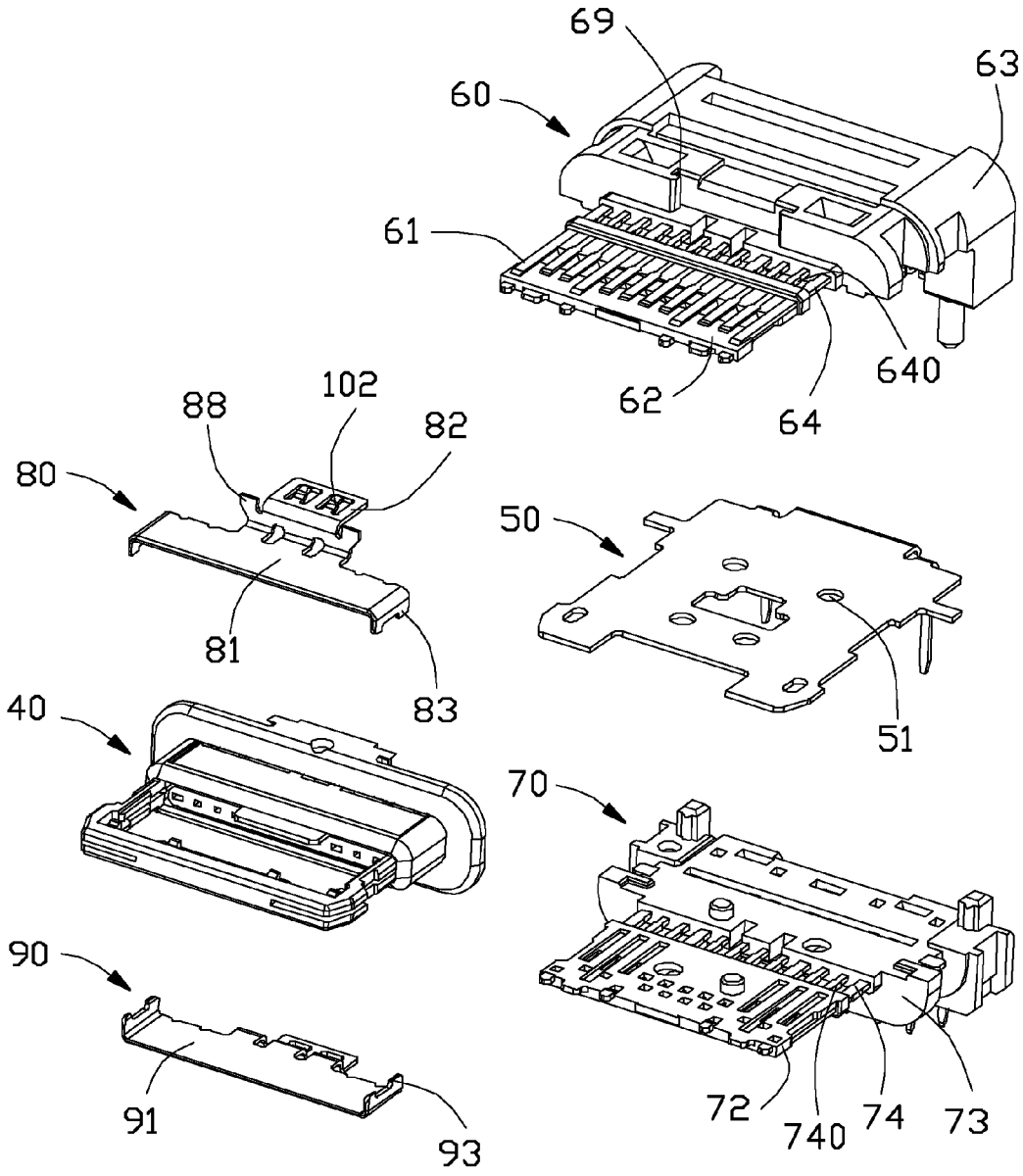
FIG. 4 is a further exploded perspective view of the terminal unit of the receptacle connector in FIG. 3.
Figure 5:
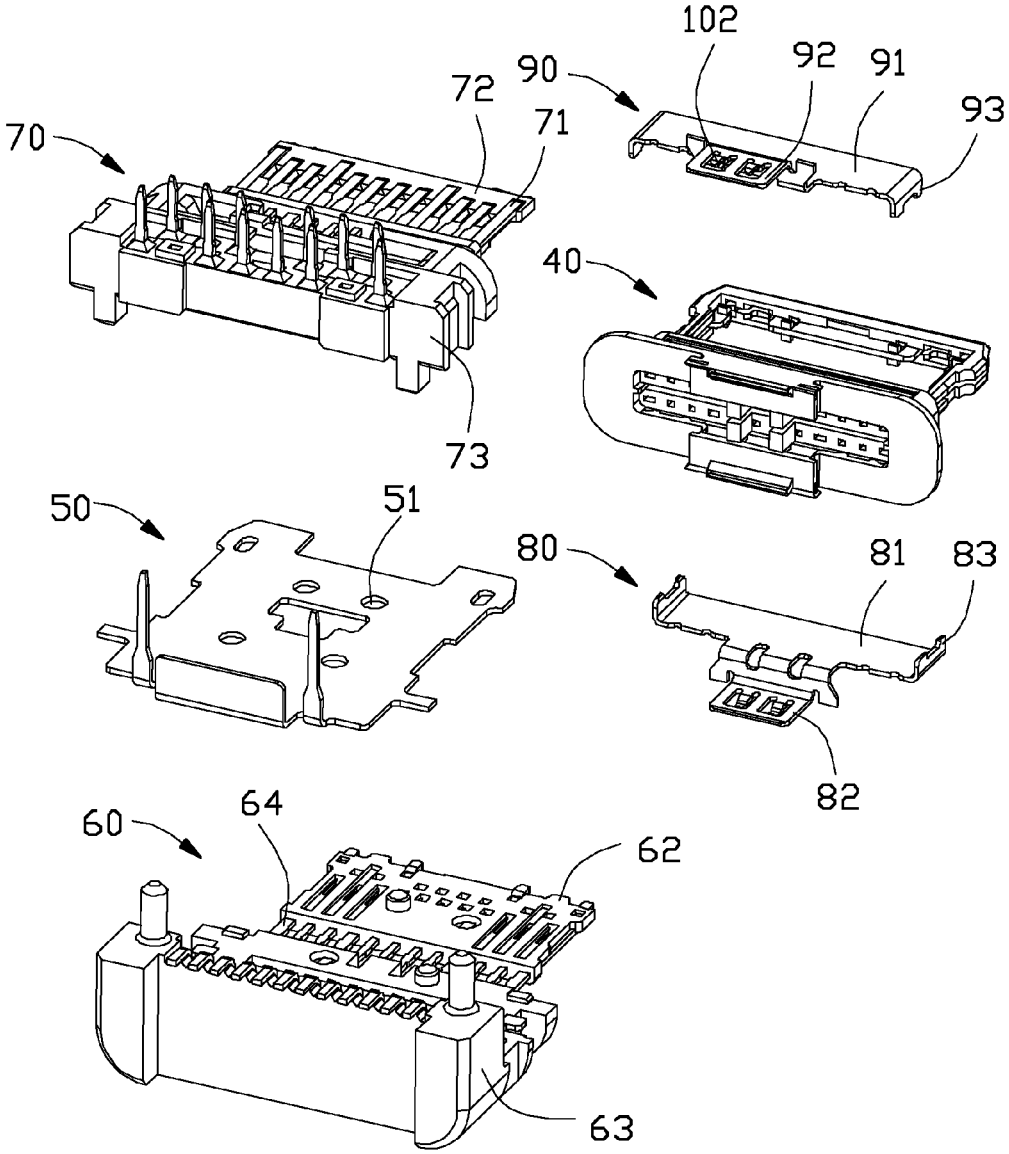
FIG. 5 is another further exploded perspective view of the terminal unit of the receptacle connector in FIG. 3.
Figure 6:
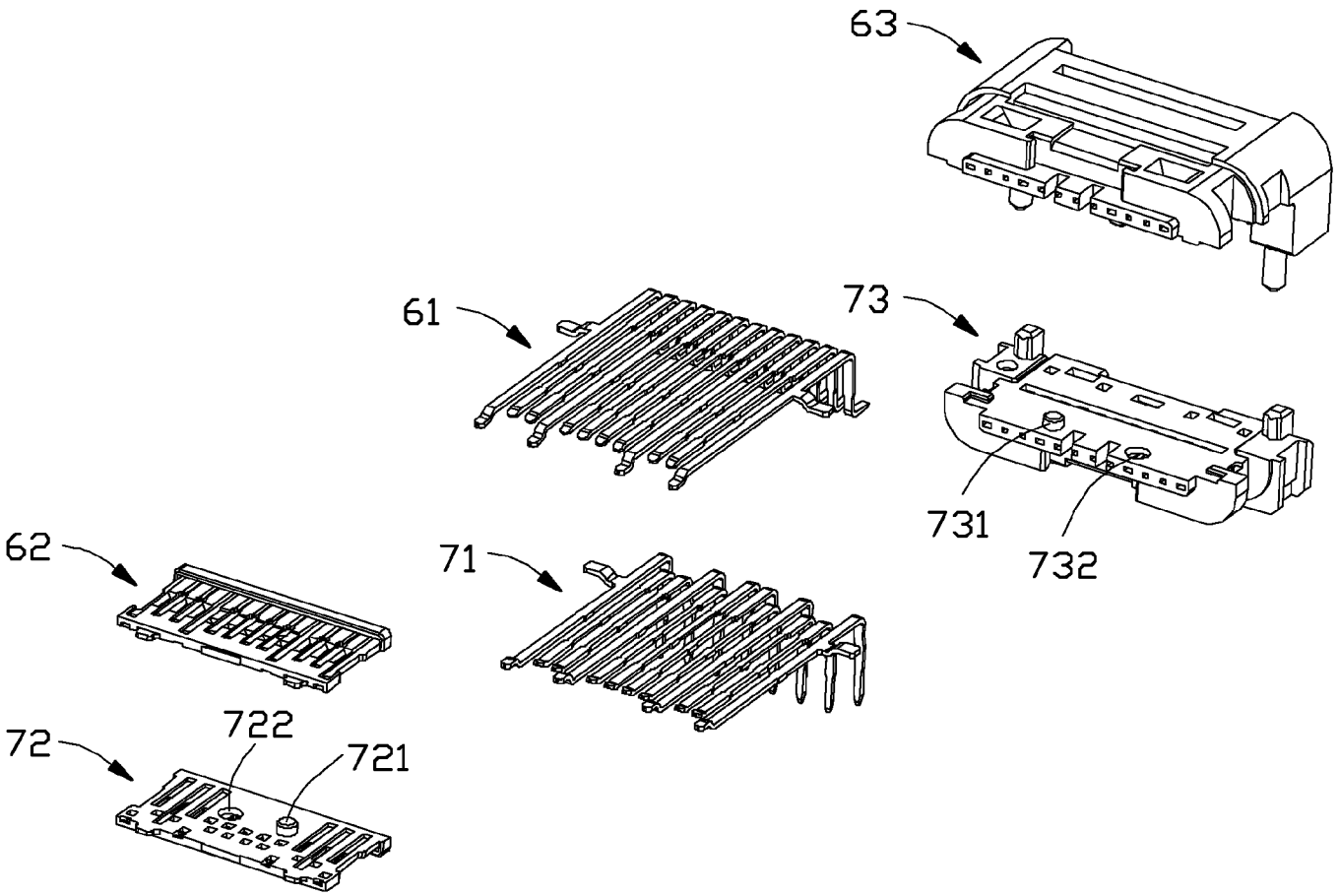
FIG. 6 is an exploded perspective view of first terminal module and second terminal module of the receptacle connector in FIG. 5.
Figure 7:
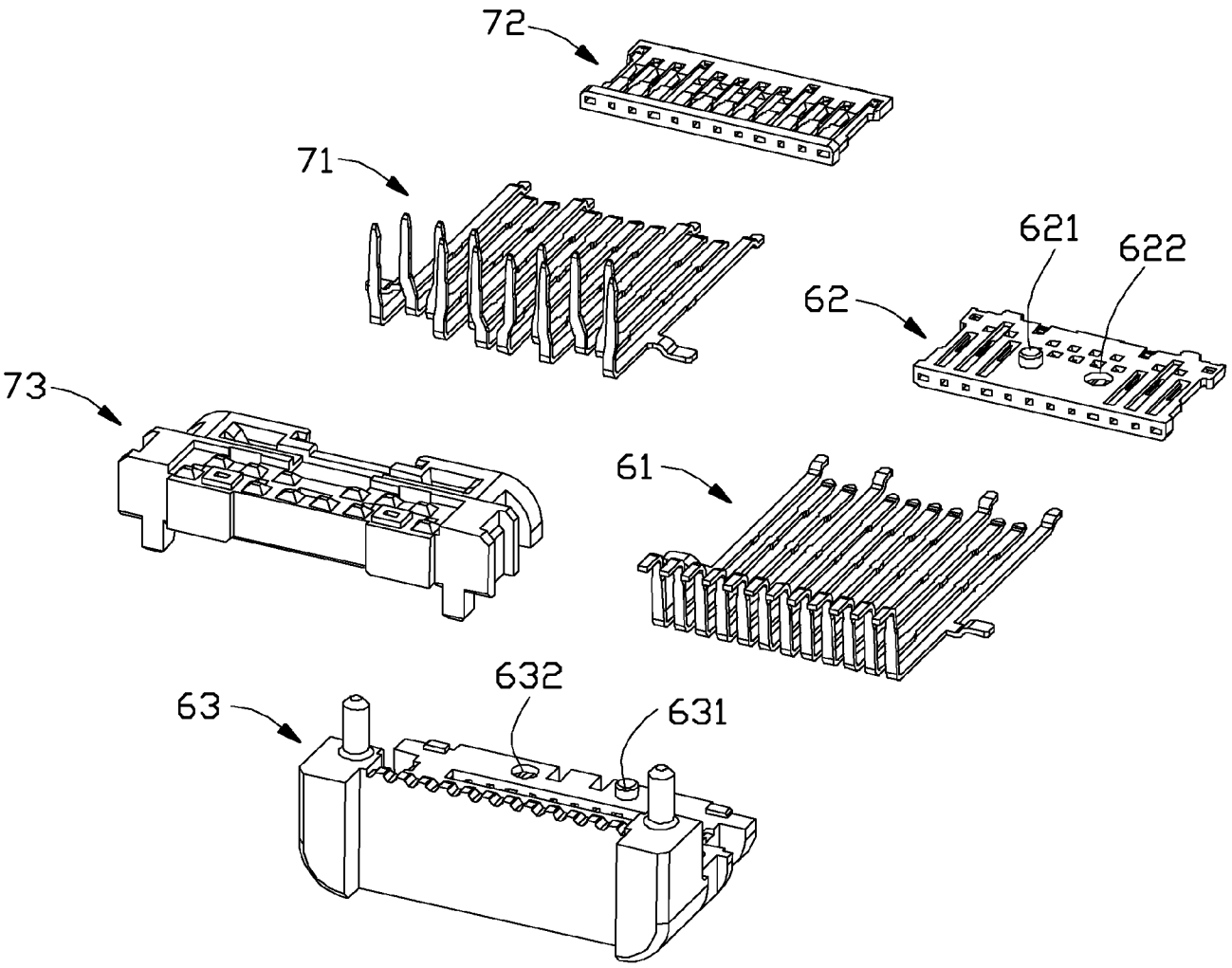
FIG. 7 is another exploded perspective view of the first terminal module and the second terminal module of the receptacle connector in FIG. 5.
Figure 8:
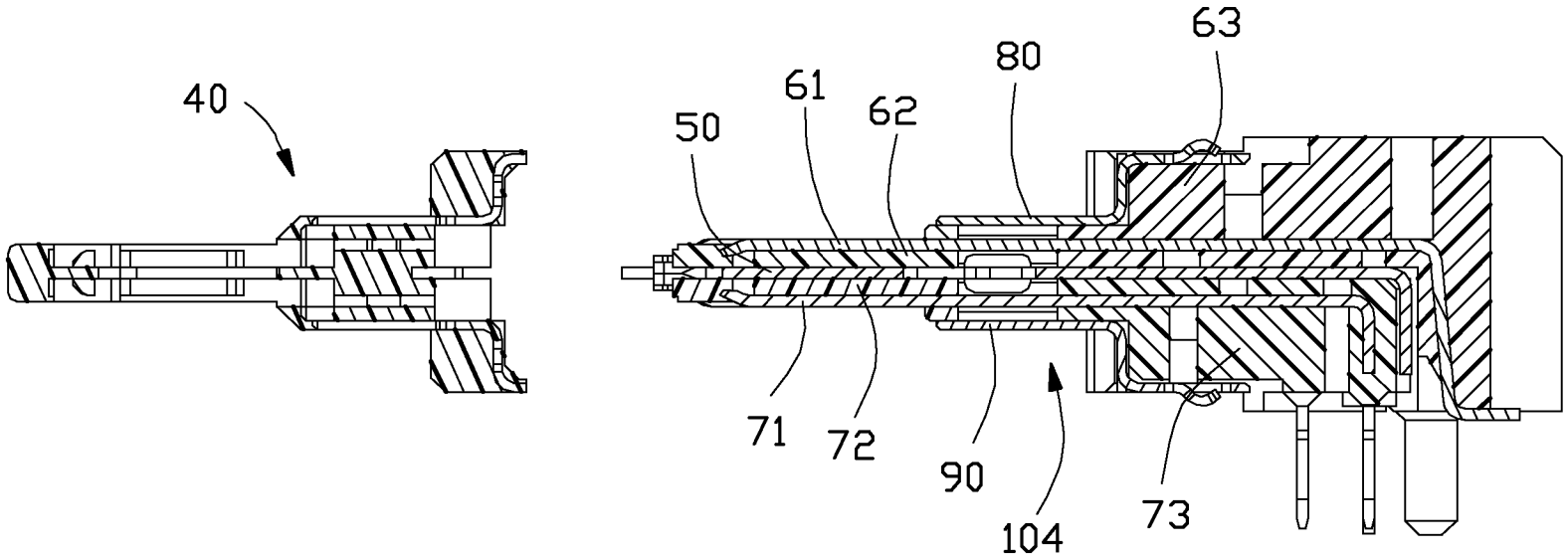
FIG. 8 is a cross-sectional view of the exploded terminal unit of the receptacle connector of FIG. 3
Figure 9:
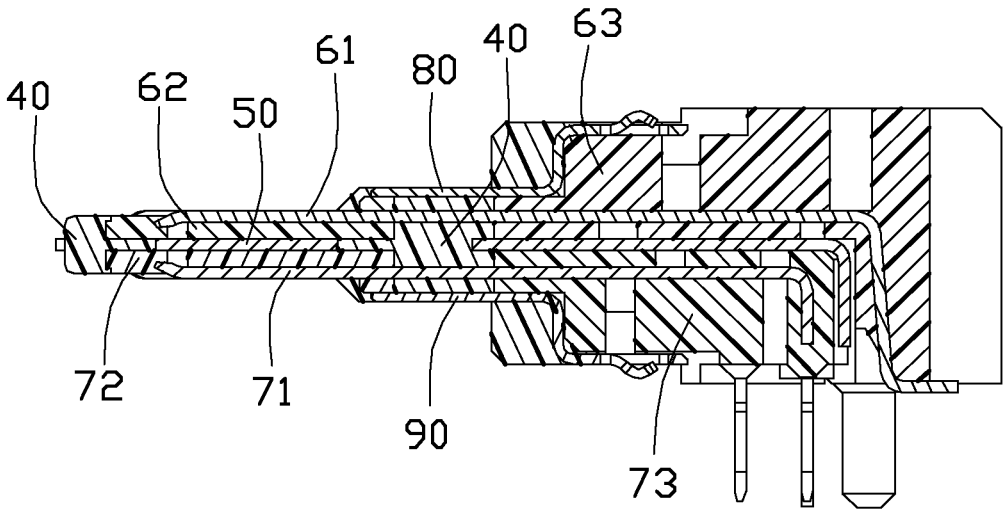
FIG. 9 is a cross-sectional view of the assembled terminal unit of the receptacle connector of FIG. 3.
Figure 10:
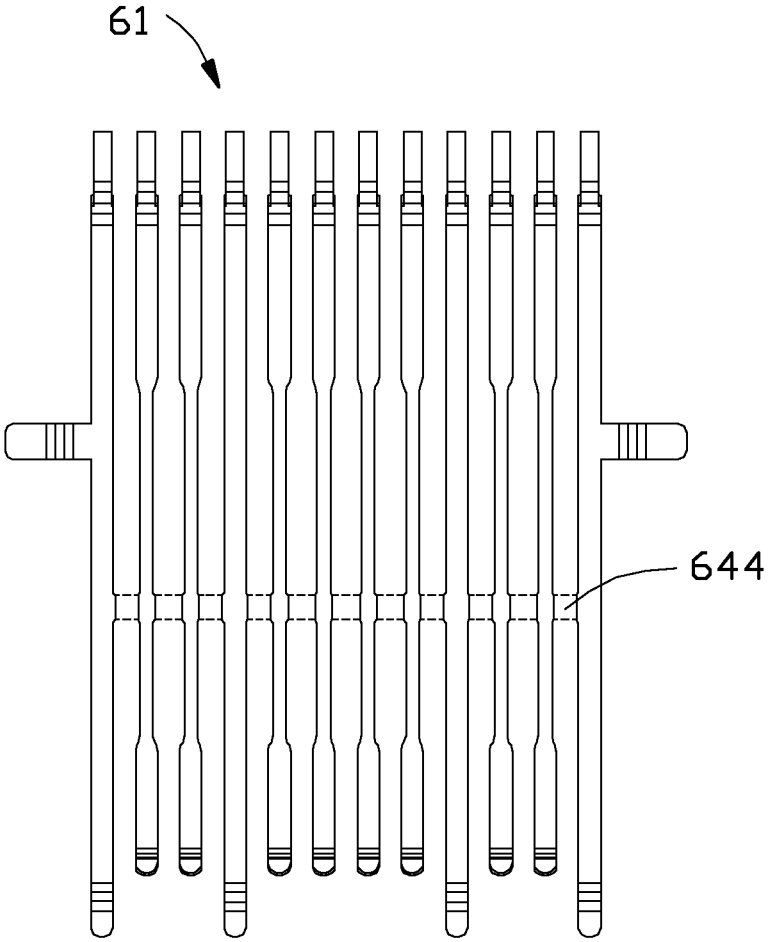
FIG. 10 is an elevational view of the contacts to show where the linking bridges are linked thereto.

Referring to FIGS. 1-10, the receptacle connector 100 for use with a plug connector (not shown) mated with a flippable way, includes a terminal unit 10, a metallic shield 20 enclosing the terminal unit 10, and a mating cavity 101 surrounded by the metallic shield 20 and forwardly communicating with an exterior in a front-to-back direction. The terminal unit 10 includes a mating tongue 103 extending into the mating cavity 101. The mating cavity 101 forms an elliptical cross-section and symmetrical with regard to the mating tongue 103 so as to allow the plug connector (not shown) to be mated therewith in a flippable way. A metallic bracket 30 is attached upon the shield 20 for assisting mounting of the electrical connector 100 upon the printed circuit board (not shown).

The terminal unit 10 includes a terminal module 104 and an insulative tongue piece 40 integrally formed/filled upon/within the terminal module 104. The terminal module 104 includes a first/upper terminal module 60, a second/lower terminal module 70, a metallic shielding plate 50 sandwiched between the upper terminal module 60 and the lower terminal module 70, and the upper metallic grounding collar 80 and the lower metallic grounding collar 90 respectively located upon the upper terminal module 60 and the lower terminal module 70. The shielding plate 50 forms four through holes 51. The upper terminal module 60 includes a first insulator and a plurality of first/upper contacts 61 embedded within the first insulator via a (first stage) insert-molding process, and the lower terminal module 70 includes a second insulator and a plurality of second/lower contacts 71 embedded within the second insulator via another (first stage) insert-molding process. The first insulator includes a first front insulator 62 and a first rear insulator 63 spaced from each other in a front-to-back direction; the second insulator includes a second front insulator 72 and a second rear insulator 73 in a front-to-back direction. Correspondingly, the upper contact 61 has a first end region enclosed in the first front insulator 62, a second end region enclosed in the first rear insulator 63, and a first connection region 64 located between the first end region and the second end region and exposed to an exterior. Similarly, the lower contact 71 has a first end section enclosed in the second front insulator 72, a second end section enclosed in the second rear insulator 73, and a second connection section 74 located between the first end section and the second end section and exposed to the exterior. The first end region of the upper contact 61 is exposed upon the upper surface of the first front insulator 62, and the front end section of the lower contact 71 is exposed upon an undersurface of the second front insulator 72 so as to form a mating portion for mating with the plug connector. On the other hand, the second end region of the upper contact 61 and the second end section of the lower contact 71 extend out of the corresponding first rear insulator 63 and the second rear insulator 73 to form a mounting portion for soldering to a printed circuit board.

The first front insulator 62 includes a downwardly extending securing post 621 and a receiving hole 622 transversely aligned with each other; the first rear insulator 63 includes a downwardly extending securing post 631 and a receiving hole 632 transversely aligned with each other. The second front insulator 72 includes an upward extending securing post 721 and a receiving hole 722 transversely aligned with each other; the second rear insulator 73 includes an upwardly extending securing post 731 and a receiving hole 732 transversely aligned with each other. The securing post 621 and the securing post 631 extend through the corresponding through holes 51 in the shielding plate 5 to be received within the corresponding receiving hole 722 and the corresponding receiving hole 732, respectively. The securing post 721 and the securing post 731 extend through the corresponding through holes 51 to be received within the corresponding receiving hole 622 and the corresponding receiving hole 632, respectively. The upper terminal module 60 and the lower terminal module 70 are secured to each other.

The upper grounding collar 80 and the lower grounding collar 90 includes a first main body 81 and a second main body 91, and a first abutting plate 82 and a second abutting plate 92 respectively extending from the first main body 81 and the second main body 91, respectively. Each of the first abutting plate 82 and the second abutting plate 92 forms a plurality of transversely arranged spring tangs 102. A pair of first bent sections 83 extend downwardly from two opposite ends of the first main body 81; a pair of second bent sections 93 extend upwardly from two opposite ends of the second main body 91. The upper grounding collar 80 is downwardly assembled upon the first rear insulator 63 so as to shield the exposed first connection region 64. The first abutting plate 82 abuts against the first rear insulator 63. The lower grounding collar 90 is upwardly assembled to the second rear insulator 73 so as to shield the exposed second connection section 74. The second abutting plate 92 abuts against the second rear insulator 73. It is noted that the upper grounding collar 80 forms a pair of wings 88 interferentially received within the corresponding grooves 69 in the first rear insulator 63 so as to efficiently retain the upper grounding collar 80 to the first rear insulator 63. The lower grounding collar 90 and the second rear insulator 73 also have the similar structures for retention therebetween.

After assembling, the shielding plate 50, the upper terminal module 60, the lower terminal module 70, the upper grounding collar 80 and the lower grounding collar 90 commonly form a base. The insulative tongue piece 40 is then successively filled within and upon such a base via a second stage insert-molding process so as to finalize the whole terminal unit 10 including the mating tongue 103. Furthermore, the spring tangs 102 contact the shield 20. Understandably, the space between the first front insulator 62 and the first rear insulator 63 is filled with material of the insulative tongue piece 40 during the second stage insert-molding process, and the space between the second front insulator 72 and the second rear insulator 73 is as well. On the other hand, such a space also may be optionally partially filled instead of fully for impedance consideration.

Notably, the upper contacts 61 are originally connected with one another in the transverse direction via (transversely extending) linking bridges 644 each between every two neighboring upper contacts 61 for assuring true positions of the upper contacts 61 after the first stage insert-molding process. Such linking bridges 644 are located at the first connecting region 64 with the mark 640 left after removing. Understandably, in the aforementioned U.S. Publication No. 2015/0222059, the upper insulator is of one piece and the linking bridges are embedded within the formed insulator while being exposed via the corresponding through holes aligned therewith in the vertical direction. Anyhow, it is hard to remove the linking bridges only via such a through holes structure aligned with the linking bridges. Differently, in the invention, the upper/first insulator is divided into the first front insulator 62 and the first rear insulator 63 to fully expose the middle connection region 64 where the linking bridges are connected. Therefore, advantageously it is relatively easy to remove the linking bridges after the first stage insert-molding process is complete and before the second stage insert-molding is ready. The lower contacts 71 and the second/lower insulator (including the spaced second front insulator 72 and second rear insulator 73) are also arranged similarly.

What is claimed is:

1. An electrical connector comprising:

a terminal unit enclosed in the metallic shield, said terminal unit including:

a terminal module and an insulative tongue piece to commonly define a mating tongue extending into the shield, said terminal module including a first terminal module, a second terminal module commonly sandwiching a metallic shielding plate therebetween, the first terminal module including a first front insulator and a first rear insulator spaced from each other with a first space therebetween in a front-to-back direction, a plurality of first contacts integrally assembled with said first front insulator and said first rear insulator, via a first stage insert-molding process, with middle connection regions thereof exposed in the first space;

the second terminal module including a second front insulator and a second rear insulator spaced from each other with a second space therebetween in the front-to-back direction, a plurality of second contacts integrally assembled with said second front insulator and said second rear insulator, via another first stage insert-molding process, with middle connection sections thereof exposed in said second space;

said insulative tongue piece being integrally assembled with the terminal module via a second stage insert-molding process; wherein each of said first contacts has on the middle connection a mark derived from removal of a corresponding linking bridge which is linked between every adjacent two first contacts for assuring true positions of the first contacts during the first stage insert-molding process; wherein each of said second contacts has on the middle connection a mark derived from removal of a corresponding linking bridge which is linked between every adjacent two second contacts for assuring true positions of the second contacts during the first stage insert-molding process.

2. The electrical connector as claimed in claim 1, wherein each of said first space and said second space is at least partially filled with material of said insulative tongue piece.

3. The electrical connector as claimed in claim 1, further including a pair of first and second metallic grounding collars respectively assembled upon the first rear insulator and the second insulator before the second stage insert-molding process and retained by the insulative tongue piece after the second stage insert-molding process.

4. The electrical connector as claimed in claim 3, wherein said first and second metallic grounding collars are assembled to the corresponding first rear insulator and said rear insulator in opposite vertical directions perpendicular to said front-to-back direction.

5. The electrical connector as claimed in claim 4, wherein said first and second metallic grounding collars are interferentially retained to the corresponding first and second rear insulators, respectively, before the second stage insert-molding process.

6. The electrical connector as claimed in claim 3, wherein said first grounding collar and said second grounding collar covers the corresponding first space and second space in a vertical direction perpendicular to said front-to-back direction.

7. The electrical connector as claimed in claim 6, wherein each of said first grounding collar and said second grounding collar further includes a pair of bent section at two opposite ends in a transverse direction perpendicular to both said front-to-back direction and said vertical direction to cover the corresponding first space and second space in the transverse direction.

8. The electrical connector as claimed in claim 3, wherein said insulative tongue piece covers a front end edge of the mating tongue, and a front edge of each of the corresponding first grounding collar and second grounding collar.

9. A method of making an electrical connector comprising steps of:

providing a first terminal module with a plurality of first contacts integrally formed, via a first-stage insert-molding process, with opposite first front insulator and first rear insulator which are spaced from each other with therebetween a first space in front-to-back direction, wherein a plurality of first linking bridges are respectively linked between every adjacent two first contacts in the first space during said first stage insert-molding process while being removed after the first stage insert-molding process;

providing a second terminal module with a plurality of second contacts integrally formed, via another first stage insert-molding process, with opposite second front insulator and second rear insulator which are spaced from each other with therebetween a second space in the front-to-back direction, wherein a plurality of second linking bridges are linked between every adjacent two second contacts in the second space during said another first stage insert-molding process while being removed after said another first stage insert-molding process;

providing a metallic shielding plate sandwiched between the first terminal module and said second terminal module to commonly form a base; and applying an insulative tongue piece upon the base via a second stage insert-molding process to form a complete mating tongue of the electrical connector.

10. The method as claimed in claim 9, wherein said first space and said second space is at least partially filled with material of said insulative tongue piece during the second stage insert-molding process.

11. The method as claimed in claim 9, further including a step of providing a pair of metallic grounding collars assembled upon the corresponding first rear insulator and second rear insulator, respectively, after said first stage insert-molding process and said another first stage insert-molding process and before the second stage insert-molding process.

12. The method as claimed in claim 11, wherein said pair of grounding collars are assembled to the corresponding first rear insulator and second rear insulator in opposite vertical directions perpendicular to said front-to-back direction.

13. The method as claimed in claim 11, wherein said pair of grounding collars respectively cover the corresponding first space and second space in a vertical direction perpendicular to said front-to-back direction.

14. The method as claimed in claim 13, wherein said pair of grounding collars further cover the corresponding first space and second space in a transverse direction perpendicular to both said front-to-back direction and said vertical direction.

15. An electrical connector comprising:

a first terminal module including:

a first front insulator and a first rear insulator spaced from each other with therebetween a first space in a front-to-back direction;

a plurality of first contacts integrally assembled, via a first stage insert-molding process, with said first front insulator and said first rear insulator, each of said first contacts forming a pair of marks on two opposite lateral side edges where a pair of linking bridges are originally linked in a transverse direction, which is perpendicular to said front-to-back direction, during the first stage insert-molding process while being removed after the first stage insert-molding process;

an insulative tongue piece integrally formed with said first terminal module via a second stage insert-molding process so as to form a complete mating tongue of the electrical connector where front contacting sections of the first contacts are exposed in a vertical direction perpendicular to said front-to-back direction; wherein said first space is at least partially filled with material of said insulative tongue piece during the second stage insert-molding process.

16. The electrical connector as claimed in claim 15, further including a first metallic grounding collar assembled upon the first rear insulator after the first stage insert-molding process and integrally assembled with the insulative tongue piece after the second stage insert-molding process.

17. The electrical connector as claimed in claim 16, wherein said first grounding collar covers the first space in a vertical direction perpendicular to both said front-to-back direction and said transverse direction.

18. The electrical connector as claimed ion claim 17, wherein said first grounding collar further covers the first space in the transverse direction.

19. The electrical connector as claimed in claim 17, wherein said insulative tongue piece covers a front edge of the mating tongue and a front edge of the first grounding collar.

* * * * *